United States Patent [19]

Comert et al.

[11] Patent Number: 4,867,312

[45] Date of Patent: Sep. 19, 1989

[54] CONTAINER SEALING MEANS FOR AIR AND MOISTURE SENSITIVE MATERIALS

[75] Inventors: Ahmet Comert, Chaineux; Dominique Petit, Housse-Blegny, both of Belgium

[73] Assignee: Norton Company, Worcester, Mass.

[21] Appl. No.: 258,412

[22] Filed: Oct. 17, 1988

[51] Int. Cl.[4] ..... B65D 25/10; B65D 81/30; B67C 3/00

[52] U.S. Cl. ..... 206/447; 206/524.4; 220/93

[58] Field of Search ..... 220/1 R, 93; 206/219, 206/425, 447, 524.3, 524.4, 524.5, 524.6, 524.7; 53/445, 472, 474, 475

[56] References Cited

U.S. PATENT DOCUMENTS 929,610 7/1909 Lilly ..... 206/524.4
2,862,616 12/1958 Capozzi ..... 206/219
2,935,189 5/1960 Barton ..... 206/524.7
2,936,884 5/1960 Marsh ..... 206/524.4
3,645,975 2/1972 Bernstein ..... 53/574
4,318,475 3/1982 Robinson ..... 206/447
4,334,615 6/1982 Butler ..... 206/447
4,467,915 8/1984 Snyder ..... 206/447
4,773,556 9/1988 Smith ..... 220/93

FOREIGN PATENT DOCUMENTS 2132164 7/1984 United Kingdom ..... 220/93

*Primary Examiner*—George E. Lowrance
*Attorney, Agent, or Firm*—Arthur A. Loiselle, Jr.

[57] ABSTRACT

Drums of moisture or air sensitive materials are protected by placing on the exposed surface of the material, a layer of a fluid second material that is essentially impervious to air and moisture and is neither soluble nor miscible in the material being protected.

8 Claims, 1 Drawing Sheet

CONTAINER SEALING MEANS FOR AIR AND MOISTURE SENSITIVE MATERIALS

This invention relates to a means for storing moisture or air sensitive materials in a container and method for unloading the material from the container.

BACKGROUND OF THE INVENTION

Moisture and air sensitive or reactive materials are often shipped in drums or pails to a point of use and are removed from their containers by a simple pump if the material is not too viscous, or with a special type of pump which includes a heating platen if the material is highly viscous or a meltable solid. In the latter case a heated platen is placed against the exposed upper layer of the material stored therein to render it plastic, and the softened material can then be made to flow through an outlet passage to be used in its intended manner. Certain of such materials have a high sensitivity to exposure, to moisture or air, and some are even rendered useless by such exposure to moisture in the atmosphere. Moisture curable polymeric hot melt adhesives containing reactive isocyanate or siloxane end groups and sold commercially as Bostick Supergrip 2000, Fuller Ipatherm, Ceca Recticol and Reichold Swift are typical examples. These polymeric materials are viscous liquids at room temperature and remain in that condition until exposed to moisture, at which point the isocyanate or siloxane groups react, causing the liquid adhesive to cross link and become essentially thermoset.

When these types of polymeric materials are packaged for storage and shipment in commerce, exposure to moisture must be precluded, otherwise the foregoing undesirable reaction can occur at the exposed surface of the stored material which prevents the emptying of the container by pumping it out of the drum with the heated platen. More or less successful sealing means have been used hereintofore wherein the exposed layer of the stored moisture sensitive material has been blanketed with a layer of carbon dioxide, or it has even been suggested that bags containing desiccants be sealed in the drum over the top of the exposed layer of stored material. For one reason or another neither one of the presently available sealing means has been found to be completely satisfactory under all of the variable conditions that are found to be present when air or moisture reactive materials must be stored in a container for ultimately cooperating with a pumping means and then shipped to a point of use.

SUMMARY OF THE INVENTION

The disclosed procedure is especially suitable for storing moisture or air sensitive thermoplastic material in a container that is adapted to cooperate with a heated platen for pumping the material from the container. It provides an entirely satisfactory seal that can be removed with a conventional unloading apparatus, can be used for protecting the material from exposure to any moisture, including moisture vapor in the atmosphere. Even though the seal is in intimate sealing contact with the entire exposed upper layer of the material and the inner surface of the side wall of the container, its composition and viscosity is such that it is neither miscible nor soluble in the material it is in contact with. It also must be pumpable at room temperature or capable of being rendered pumpable upon the application of heat thereto. Another and most important property of the seal material is that it must be impervious to air and water vapor.

To accomplish this, the air moisture sensitive thermoplastic to be stored is filled into the container or drum in which it is to be stored, the filling, of course, being preferably accomplished without exposing the material to air or moisture. After the container filling step has been completed a viscous sealing material is poured on top of the exposed upper layer of the material therein. The viscous seal covers the entire surface of the air or moisture sensitive material and flows into contact with the inner surface of the side wall means of the container. The sealing layer is preferably very viscous at room temperature but readily softenable upon the application of heat.

A thermosettable liquid polymer system may also be used as the seal as long as it's insoluble and immiscible with the principle thermoplastic material in the drum. Moisture curable Bostick Supergrip 2000 is an example of such a polymer.

Such a seal adequately protects the air or moisture sensitive material from any exposure to air or water vapor during storage and shipment. At the point of use, the pump, preferably fitted with a heater, can be used to first remove the seal layer, and without being removed from the container after the seal has been removed, the platen is immediately in contact with the upper surface of the principal material which can then be heated and pumped from the container.

DESCRIPTION OF THE PREFERRED EMBODIMENT

Figure 1:
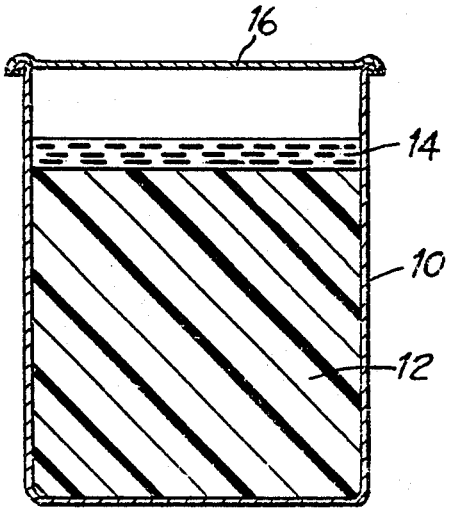
FIG. 1 is a vertical section through a sealed drum filled with a hot melt adhesive material.

A container 10 is shown in FIG. 1 filled to the usual level with a moisture sensitive hot melt adhesive material 12, (which is thermoplastic so long as it is not exposed to moisture) for cooperation with a heated platen, as will appear more fully below, for example, one of the moisture capable hot melt adhesives mentioned above. The particular moisture or air sensitive chemical that is stored in the container is immaterial except that it must be immiscible and insoluble in the sealing material and heat softenable if it is solid or highly viscous.

Figure 2:
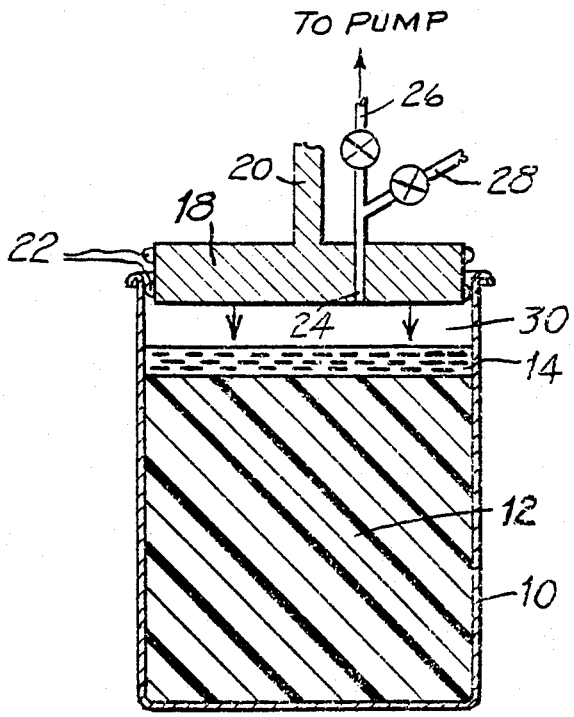
FIG. 2 is a vertical section of the drum with a heated platen about to be moved downwardly into contact with the seal.

The hot melt adhesive is covered with a seal 14. This layer is selected from a class of materials having a low moisture vapor transmission rate and also is immiscible and insoluble in the thermoplastic material. Another essential property is that it shall be or at least is adapted to be applied as a liquid to the upper surface of the stored material and that can subsequently be rendered liquid by the applications of heat such as when the heated platen is pressed downwardly against it, referring to FIG. 2. Preferably the seal 14 is viscous at room temperature to permit it to be poured onto the upper surface of the hot melt adhesive 12 to cover it and flow outwardly to have a sealing contact with the inside surface of the side wall of container 10.

Seals, for example, may be any polyhydrocarbon or similar product having the properties outlined above. The seals can be poly-hydrocarbons, such as mineral oils having a high paraffine content like Enerper sold by British Petroleum Company, Flexcon sold by the Exxon Corporation, or one that is high in naphthenic content, e.g. Coray 22 by the Exxon Corporation, Enerthene by British Petroleum Company, or waxes like Vestowax by the Huels Company or thermoplastic rubbers like Kraton sold by the Shell Corporation, or EPDM by Exxon. Many other such thermoplastic compositions may occur to those skilled in the art.

Preferably the seal 12 is a layer of polyisobutylene that is a viscous liquid at room temperature, has a low moisture vapor transmission rate and a moisture content of less than 1 ppm. The layer 14 is spread entirely over the upper exposed surface of the hot melt adhesive material 12, in layer of from 10 to 50 mm thick if desired, in the situation where the upper layer of the thermoplastic material may be uneven. The viscous nature of the preferred polyisobutylene preserves the complete moisture proof seal of the stored material even though the container may be temporarily tilted for short periods as, for example, during shipment.

The container 10 is also provided with a conventional cover 16 that must be removed to expose the contents of the drum. When the moisture curable thermoplastic adhesive is to be removed from the drum at the point of use, the cover 16 is taken off and the heated platen 18 of, for example, a Nordson Cy. Bulk Melter #506, carried on the piston rod 20 so it may be driven downwardly into the drum. The platen fits closely within the inside surface of the side wall of the drum and has ring gaskets 22 around its periphery to prevent air from entering the drum. The platen has an exhaust passage 24 leading from its lower face upwardly that connects to two branch lines 26 and 28, each of which has a valve therein. As the heated platen moves downwardly, first the space 30 is evacuated through passage 28 and it continues its downward movement to render the seal 14 liquid for removal through passage 28. When all of the seal has been evacuated, the valve in passage 28 is closed and the platen is then firmly seated against the upper surface of the solid thermoplastic material 12 in the drum. Thereafter the material 12 is heated to liquify it so that it may be delivered to its desired destination in the known manner through passage 26 without any possibility of exposure to any moisture from any source.

The preferred polyisobutylene for the viscous seal 14 is one with an average molecular weight (by number) of 2,600, a viscosity index of 236 (ASTM D2270), such as sold by Amoco as Indopol M 1900. Variations thereof can include polyisobutylene compounded with coloring pigments such as titanium dioxide or carbon black to clearly distinguish the seal 14 from the material 12.

It should be noted that when a polyisobutylene is selected with a substantially lower viscosity, while it may be poured into place more easily, a viscosity near 236 mentioned above is preferred. As the viscosity goes down, the molecular weight is less and the product will carry more water which is undesirable. If the viscosity is too high, the seal is difficult to pour, but as suggested above, such a seal can be heated to make it more liquid to be poured in place, and can be removed when it is subsequently heated to liquify the seal.

The curable reaction product can be poured in place to immediately seal the outputs of the drum from the atmosphere while it cures through reaction with moisture in the air. When such a seal is used, instead of pumping it out of the drum as described above, this reaction product can be peeled away and the heated platen quickly lowered into place on the thermoplastic material to be removed from the drum.

Comparative tests of the present seal were carried out on drums containing moisture sensitive thermoplastic material, namely that disclosed in U.S. patent application Ser. No. 07/140,851 filed Jan. 5, 1988 which is hereby incorporated herein by reference. This thermoplastic polymer cures and becomes essentially thermoset when exposed to moisture. The "unprotected" material was sealed in a conventional drum with a blanket of dry $CO_2$ and the drum sealed according to the present invention was sealed with a 15 mm thick layer of Indopol H1900. Tests were made at the intervals indicated using the method of ASTM 1638-74 on the upper layer of the thermoplastic material contained in the drum. Basically the test measures the amount of reactive groups present in the thermoplastic material. Table I shows the change in the number of reactive groups in the material as a function of time of exposure to atmospheric moisture. The results are expressed in terms of percent of reactive groups present in the sample, with the fresh unexposed material being 100% The results showed that exposure of the thermoplastic material to the atmosphere for as short a time as 30 minutes caused all of the active groups in the surface of the unprotected material to react. By contrast, material sealed according to the invention was completely uneffected. These tests showed the following:

TABLE I

| Time After Opening of the drum | Unprotected Drum | Protected Drum |
|---|---|---|
| 0 | 100% | 100% |
| 5 Minutes | 60% | 100% |
| 10 Minutes | 13% | 100% |
| 20 Minutes | 3% | 100% |
| 30 Minutes | 0% | 100% |

Outside conditions were 25° C. and 35% relative humidity.

In another test showing the more practical effects flowing from the use of this invention, a test was made of the "pumpability" of a drum of thermoplastic material the same as that above, sealed as here taught, as compared with a similarly filled drum that was left uncovered for 10 days. The mentioned Nordson Cy. Bulk Melter #506 was used and the flow as measured in g/min. at 90° C. The results were as follows:

| | Unprotected Drum | Protected Drum |
|---|---|---|
| Initial | 450 g/min. | 435 g/min. |
| After 10 days | 0 g/min. | 440 g/min. |

While the above is a description of the preferred form of this invention and method of use, it is possible that modifications thereof may occur to those skilled in the art that may fall within the scope of the following claims.

What is claimed:

1. A sealed container for storing a thermoplastic material having side and bottom wall means adapted to coact with a heated platen for emptying it when said container is situated at a point of use, said container being filled with a moisture or air sensitive thermoplastic material with its uppermost layer exposed, a seal for protecting said exposed layer of said material during storage and shipment of the container to said point of use, the seal comprising a cover that is insoluble in said material for sealing the moisture sensitive plastic in the container from moisture in the atmosphere, said cover being viscous at room temperature when poured on said exposed layer, and said cover extending over said exposed layer and being in contact with said side wall means of said container, and said seal having a low moisture vapor transmission rate.

2. A container as in claim 1 wherein said cover is a polyisobutylene which is liquid at room temperature.

3. A container as in claim 2 wherein said cover can be as thick as 50 mm.

4. A container as in claim 1 wherein said cover has a moisture content of less than two parts per million.

5. A container as in claim 1 wherein said cover is a polyisobutylene with coloring pigment.

6. A container as in claim 1 wherein said cover is an oligomer of polyisobutylene having an average molecular weight of 2,600, and a viscosity index of 236.

7. A method for first storing a moisture or air sensitive thermoplastic material in a container having side and bottom wall means adapted to cooperate with a heated platen pumping means and then for removing said stored material from the container at a point of use with said heated platen comprising filling said material into said container leaving its upper surface exposed momentarily; then immediately sealing said layer against exposure to atmospheric moisture with a cover material that has a low moisture vapor transmission rate and is viscous at room temperature, pouring said cover over said layer in a manner to spread that cover into contact with said side wall means for sealing said material against exposure to air and moisture while shipping and storing said material; and then removing said cover immediately before said heated platen is moved into contact with said upper layer to render the thermoplastic material pumpable so it can be removed from the container.

8. A method as in claim 7 wherein said cover is heated by said platen to be pumped out of said container before said platen is moved into contact with said upper layer.

* * * * *